United States Patent [19]

Gerhard

[11] Patent Number: 4,854,462

[45] Date of Patent: Aug. 8, 1989

[54] TANK CONTAINER

[75] Inventor: Helmut Gerhard, Weitefeld, Fed. Rep. of Germany

[73] Assignee: Westerwaelder Eisenwerk Gerhard GmbH., Weitefeld, Fed. Rep. of Germany

[21] Appl. No.: 175,301

[22] Filed: Mar. 30, 1988

[30] Foreign Application Priority Data

Mar. 30, 1987 [DE] Fed. Rep. of Germany ... 8704690[U]

[51] Int. Cl.[4] ..... B65D 88/06

[52] U.S. Cl. ..... 220/5 A; 220/1.5; 220/71; 220/445

[58] Field of Search ..... 220/1.5, 5 A, 71, 445

[56] References Cited

U.S. PATENT DOCUMENTS

| | | | |
|---|---|---|---|
| 3,661,293 | 5/1972 | Gerhard et al. | 220/71 |
| 3,730,384 | 5/1973 | Ramme | 220/71 |
| 3,799,383 | 3/1974 | Gerhard | 220/71 X |
| 4,060,174 | 11/1977 | Gerhard | 220/1.5 X |
| 4,307,812 | 12/1981 | Gerhard | 220/1.5 |
| 4,356,925 | 11/1982 | Gerhard | 220/1.5 |
| 4,416,384 | 11/1983 | Bjurling | 220/1.5 |
| 4,469,236 | 9/1984 | Marsault et al. | 220/71 X |
| 4,593,832 | 6/1986 | Gerhard | 220/71 X |
| 4,603,788 | 8/1986 | Gerhard | 220/71 X |
| 4,728,000 | 3/1988 | Gerhard | 220/71 |

FOREIGN PATENT DOCUMENTS

| | | | |
|---|---|---|---|
| 1937192 | 2/1971 | Fed. Rep. of Germany . | |
| 2073146 | 11/1981 | United Kingdom | 220/1.5 |

*Primary Examiner*—Philip R. Coe
*Assistant Examiner*—Stephen F. Gerrity
*Attorney, Agent, or Firm*—Barnes & Thornburg

[57] ABSTRACT

In a tank container, the tank (16) which is formed of a plurality of parallel cylindrical shells (17, 18) is connected by saddle structures (19) to a pair of end frames (10). The saddle structures (19) each consist of a U-bar (20) having its legs welded to the respective shell (17, 18) and two L-bars (21, 22) welded to the lower traverse (13) and, respectively, the corresponding corner upright (11, 12).

20 Claims, 2 Drawing Sheets

TANK CONTAINER

Figure 1:
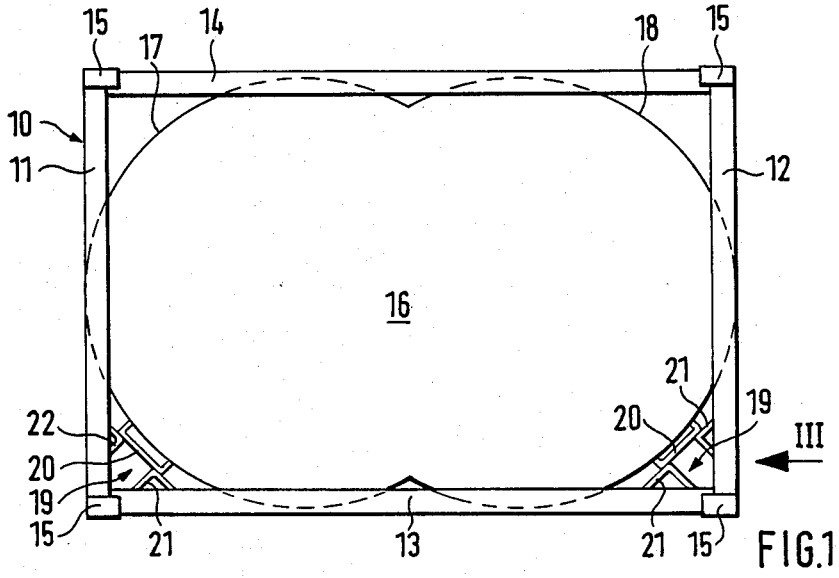

The invention relates to a tank container of the type comprising a tank having an envelope formed of a plurality of cylindrical shells, two end frames each of which includes two corner uprights and two traverses, and saddle structures connecting the tank to the end frames.

A tank container of this type is known from U.S. Pat. No. 4,593,832. There, the tank which has its envelope formed of a plurality of part-cylindrical shells is connected to end frames by means of saddle structures each of which comprises an end ring welded to the tank head and a saddle ring fixed to diagonal struts of the respective end frame. During assembly, the two rings may be displaced with respect to each other to compensate lengthwise tolerances and are subsequently welded together.

In case of very high accelerations along the tank axis, as occur in severe buffing tests, the tank may undergo permanent deformation because the diagonal distance between the lower corner fitting and the nearest connecting point at the diagonal strut of the end frame results in excessive torque.

With a tank the envelope of which is formed of a plurality of adjacent part-cylindrical shells in order optimally to utilize the volume defined by the end frames, there is insufficient space for lower diagonal supports known from U.S. Pat. No. 4,603,788, which form additional supports for a tank otherwise mounted by end saddles and introduce the forces immediately into the lower corner fittings.

It is the object of the invention at least partly to overcome disadvantages as occur with comparable prior art tank containers. A more specific object of the invention may be seen to reside in providing a saddle support for a tank container of the type initially referred to, which permits introducing axial forces into the lower corner fittings along a straight line and over a distance that is as short as possible and which, at the same time, consists of a small number of readily manufactured parts permitting simple assembly.

To meet this object, a tank container according to the invention comprises a tank having an envelope formed of a plurality of cylindrical shells, two end frames each of which includes two corner uprights and two traverses, and saddle structures connecting the tank to the end frames, each saddle structure including a U-bar extending parallel to the axis and having the edges of its two legs fixed to the respective shell in such a way that its web is inclined, and two L-bars having the edges of both of their legs fixed to the inner surfaces of the respective corner upright or lower traverse, one of the legs being welded to the respective parallel surface portion of the U-bar.

The saddle structures may thus each consist, in their simplest form, of one U-bar and two L- or angle bars, i.e. of inexpensive, commercially available profiled material. During assembly, the two L-bars may be moved relative to the U-bar welded to the tank both in the longitudinal direction and transversely thereto so that tolerances may be compensated. The final welding of the L-bars to the end frame and U-bar is done in a state in which all parts are positioned relatively to each other so as to result in the desired configuration. A dimensionally accurate assemblage of a pre-fabricated tank with prefabricated end frames is thus facilitated by moving and subsequently welding light-weight structural parts without much labour or corrective and adaptive flame cutting or forming.

When the tank envelope is formed of a plurality of parallel part-cylindrical shells, the corner region which exists between the tank envelope and the end frame and is about triangular if viewed in the axial direction has a comparatively small area. Therefore, the U-bar is close to the corner fitting with relatively short legs so that the forces which the tank applies to the U-bar are transmitted to the end frame in the close vicinity of the corner fitting via the L-bars connected to the U-bar.

DE-A-1,937,192 discloses a tank container which is mounted by brackets provided in the two lower corners. These brackets, however, are structures of complicated shape which must be adapted not only to the tank but also to the space existing between the tank and the frame and therefore do not permit the compensation of tolerances. Moreover, they require a framework with a complete base structure and thus do not allow a mere end-side mounting of the tank to end frames.

Preferred embodiments of the invention relate to configurations that are advantageous from the standpoint of increasing the overall rigidity of the tank-container mounting, simplifying the assembly, and integrating grappler arm lifting areas as are regularly required with land containers and tanks for changing transport forms.

Figure 4:
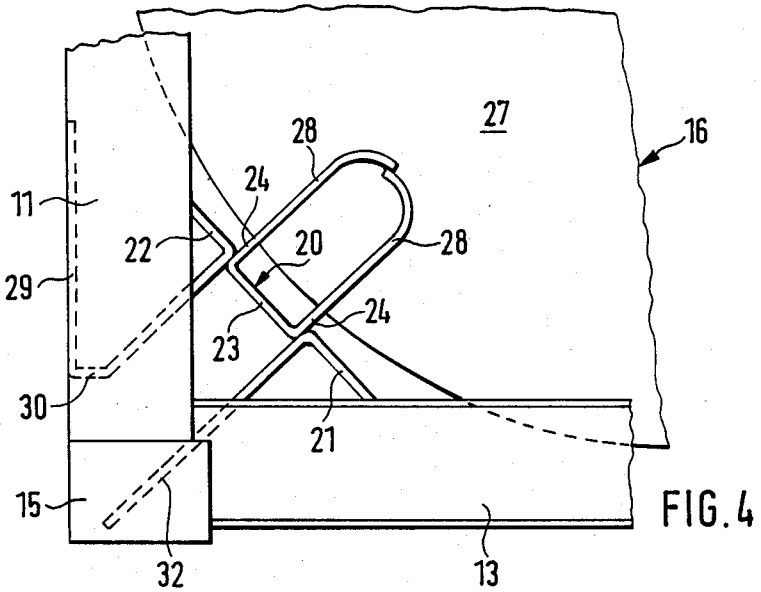
Figure 2:
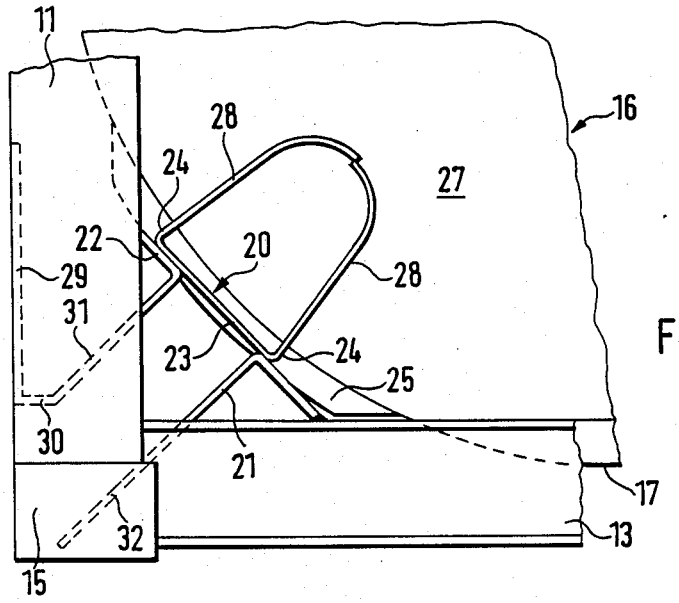
Figure 3:
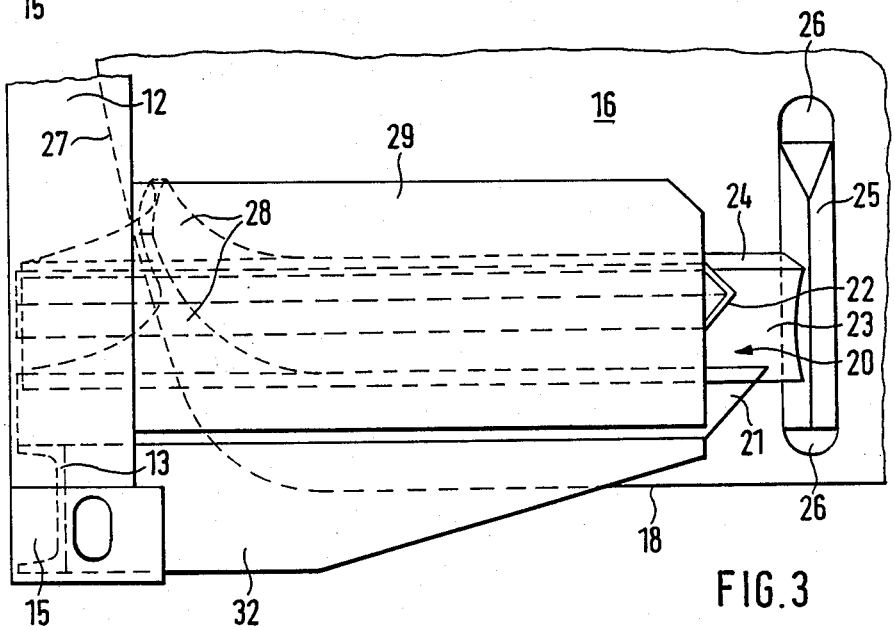

Details of the invention will now be explained with reference to the drawings, in which FIG. 1 is an end view of a tank container according to a preferred embodiment of the invention, FIG. 2 is an enlarged view of the left-hand lower corner region of the tank container of FIG. 1, FIG. 3 is a lateral view of the right-hand lower corner region, as viewed in the direction of the arrow III in FIG. 1, and FIG. 4 is a view similar to FIG. 2 showing a modified embodiment.

The end frame 10 of the tank container shown in FIG. 1 consists of two corner uprights 11, 12 and two traverses 13, 14 interconnected by corner fittings 15. The tank 16 is connected to the end frame 10 by two saddle structures generally designated 19 in FIG. 1.

The tank 16 includes an envelope formed of two part-circular cylindrical shells 17, 18, the axes of the two cylinders extending parallel to each other in a common horizontal plane. Alternatively, the tank envelope may be formed of three part-circular cylindrical shells with parallel axes contained in one horizontal plane. Tank containers having envelopes of this type are known e.g. from U.S. Pat. No. 3,799,383. In a further modification for which the saddle-type mounting described below is suitable, the tank envelope is formed of four parallel part-circular cylindrical shells the axes of which define in a transverse plane the four corners of a rectangle. A tank container with such a tank is known from U.S. Pat. No. 4,593,832. In all these tanks in which the envelope is made of a plurality of part-cylindrical shells, the approximately triangular region defined in FIG. 1 by the lower traverse 13, the left-hand or right-hand corner upright 11, 12 and the projection of the respective shell 17, 18, is relatively small as compared to a tank container having a full-circular cylindrical tank envelope.

Each of the two saddle structures 19 according to FIGS. 1 to 3 includes a U-bar 20 having the edges of its legs 24 welded to the respective shell 17, 18 and two L-bars 21, 22 having the edges of both of their legs welded to the upper surface of the lower traverse 13 and, respectively, the inner surface of the corresponding corner upright 11, 12. An outer surface of each L-bar 21, 22 is welded to the outer surface of the web 23 of the U-bar 20.

In the embodiment of FIGS. 1 to 3, the U-bar 20 has a comparatively wide web 23 and comparatively short legs 24. This on the one hand results in sufficient contacting surfaces between the web 23 of the U-bar 20 and the respective leg of the L-bars 21, 22, and on the other hand leaves sufficient cross-sectional area in which the L-bars may be readily inserted.

Upon assembly, the tank 16 with the U-bars 20 welded thereto is brought into the desired alignment with respect to the end frame 10 whereupon the L-bars 20, 21 are inserted and moved horizontally along the traverse 13 and, respectively, vertically along the upright 11, 12 until they contact the outer surface of the web 23 of the U-bar 20. Subsequently, the edges of the legs of the L-bars 21, 22 are welded to the inner surfaces of the traverse 13 or upright 11, 12, respectively. Until the L-bars 21, 22 are welded to the U-bar 20, lengthwise tolerances that may exist between the tank 16 and the end frame 10 may be compensated by shifting the tank in the axial direction.

As appears from FIG. 3, the L-bars 21, 22 extend in the axial direction of the tank beyond the axial width of the traverse 13 and uprights 11, 12. Also, the U-bar 20 welded to the respective tank shell 17, 18 extends beyond the tank envelope and terminates short of the outer end surface of the end frame 10. Sufficient length for interconnecting the three bars 20, 21 and 22 is thus made available.

At the other end, the U-bar 20 terminates at a reinforcing member 25 extending in the circumferential direction of the tank 16, the member 25 in the embodiment of FIG. 3 having an L-shaped cross-section and terminating in low-stress rounded portions 26. Alternatively, the U-bar may terminate at a reinforcing ring which completely surrounds the tank envelope.

As further shown in FIG. 3, the end of the U-bar 20 facing the end frame 10 is supported by the tank head 27 by two junction plates 28 which are fitted between the legs 24 of the U-bar 20 and the outer surface of the tank head 27, the free edges of the junction plates 28 extending in an inclined or curved manner from the outer end of the U-bar 20 to the tank head 27.

As further indicated in FIGS. 2 and 3, the two junction plates 28 have their ends bent towards each other to result in a continuous weld on the tank head 27. Peak stresses are thus avoided which are otherwise liable to occur at the free ends of welds of force transmitting members.

FIG. 3 also shows a generally rectangular junction plate 29 connected to the upright 12 which according to FIG. 2 has its lower edge bent inwardly to form a grappler arm lifting area 30 and serves as a guide when engaged by grappler arms. According to FIG. 2, the grappler arm lifting area 30 is also connected by a further inclined junction plate 31 to the diagonally downwardly and outwardly extending leg of the L-bar 22, which results in an essential stiffening of both the grappler arm lifting area 30 and the L-bar 22 itself.

It is further indicated in FIG. 2 that the diagonally downwardly and outwardly extending leg of the L-bar 21 welded to the traverse 13 may be extended by a junction plate 32 the lower edge of which is inclined inwardly in the longitudinal direction of the tank. The L-bar 21 may thus be stiffened in similar way as the L-bar 22 by means of the junction plate 32. In both cases, the junction plates 31 and 32 are advantageously welded to the vertical inner surface of the upright 11, 12 and traverse 13, respectively.

As assumed in FIG. 2, the U-bar 20 is welded to the tank shell 17, 18 in such a manner that its web 23 and legs 24 extend at an angle of 45° with respect to the horizontal and vertical. In this case, isosceles L-bars 21, 22 are used, but the leg width may be different for the two L-bars 11, 12 as shown in FIG. 1.

The modified embodiment shown in FIG. 4 differs from that of FIG. 2 in that the two L-bars 21, 22 abut the legs 24 rather than the web 23 of the U-bar 20. In this case, the width of the web 23 of the U-bar 20 is reduced whereas the height of its legs 24 is increased. Such a shape may be preferred depending on the position of the tank shells 17, 18 relative to the end frame 10.

In either case, the forces exerted by the tank 16 are transmitted via the U-bar 20 and the L-bars 21, 22 connected therewith to the end frame 10 at a location that is immediately adjacent the respective corner fitting 15. In other words, the lever arm effective between the location where the load is transmitted from the tank and the corner fitting which transmits this load to the corresponding vehicle or other supporting system is relatively short which results in a correspondingly small torque even under high axial acceleration.

Depending on the size of the tank container and the load to be transmitted, the saddle structures 19 described above may be provided as the sole connecting elements between the tank 16 and end frames 10 or in addition to other connecting elements provided in the upper frame area.

What is claimed is:

1. A tank container comprising a tank having an envelope formed of a plurality of interconnected part cylindrical shells extending with parallel axes, first end frame means at a first axial end of the tank, said first end frame means including a first corner upright and a first transverse interconnected with one another to form a first corner frame support, a first saddle structure means connecting the first corner frame support to the tank, said first saddle structure means including:

a U-bar formed with two U-bar legs interconnected by a U-bar web, said U-bar extending substantially parallel to the tank shell axes and having end edges of its legs attached to a respective shell with its U-bar web spaced from the shell and inclined with respect to the first corner upright, and first and second L-bars which each have a pair of legs extending outwardly from a common apex, said first L-bar being attached to the U-bar at one of its legs and being attached to the first transverse at both of its legs, said second L-bar being attached to the U-bar at one of its legs and being attached to the first upright at both of its legs.

2. A tank container according to claim 1, wherein an end edge of the U-bar facing away from the first corner frame support is welded to a reinforcing member extending in the circumferential direction of the tank.

3. A tank container according to claim 1, wherein an end of the U-bar facing the first corner frame support is supported by junction plates fitted between the U-bar legs and the tank shell.

4. A tank container according to claim 3, wherein ends of the junction plates are bent towards each other to form a continuous weld on the tank shell.

5. A tank container according to claim 4, wherein each of four bottom corners of the tank containers are provided with corner frame supports and saddle structure means similar to said first corner frame support and said first saddle structure means.

6. A tank container according to claim 1, wherein the L-bars extend beyond the axial width of the first corner frame support in the direction of the tank shells away from the first corner frame support.

7. A tank container according to claim 6, wherein the second L-bar is connected to a junction plate forming a grappler edge.

8. A tank container according to claim 6, wherein at least one leg of at least one of the L-bars is connected to a further junction plate fixed to an inner surface of the first corner frame support facing the tank shells.

9. A tank container according to claim 8, wherein each of four bottom corners of the tank containers are provided with corner frame supports and saddle structure means similar to said first corner frame support and said first saddle structure means.

10. A tank container according to claim 1, wherein the first and second L-bars contact the web of the U-bar.

11. A tank container according to claim 10, wherein each of four bottom corners of the tank containers are provided with corner frame supports and saddle structure means similar to said first corner frame support and said first saddle structure means.

12. A tank container according to claim 1, wherein the first and second L-bars contact the legs of the U-bar.

13. A tank container according to claim 12, wherein each of four bottom corners of the tank containers are provided with corner frame supports and saddle structure means similar to said first corner frame support and said first saddle structure means.

14. A tank container according to claim 1, wherein the web of the U-bar extends at an angle of substantially 45° with respect to the first corner upright and first transverse of the frame corner frame support.

15. A tank container according to claim 14, wherein each of four bottom corners of the tank containers are provided with corner frame supports and saddle structure means similar to said first corner frame support and said first saddle structure means.

16. A tank container according to claim 1, wherein said first end frame means comprises:

a second corner upright and a second transverse interconnected with one another to form a second corner frame support disposed at a side of the tank opposite the first corner frame support:

a second saddle structure means connecting the second corner frame support to the tank, said second saddle structure means including a second U-bar formed with two U-bar legs interconnected by a U-bar web, said second U-bar extending substantially parallel to the tank shell axes and having end edges of its legs attached to a respective shell with its U-bar web spaced from the shell and inclined with respect to the second corner upright, and third and fourth L-bars which each have a pair of legs extending outwardly from a common apex, said third L-bar being attached to the second U-bar at one of its legs and being attached to the first transverse at both of its legs, said fourth L-bar being attached to the second U-bar at one of its legs and being attached to the first upright at both of its legs.

17. A tank container according to claim 16, wherein said first and second transverses are formed by a continuous end frame member extending transversely along the bottom of the tank container at one end thereof.

18. A tank container according to claim 1, wherein an end edge of the U-bar facing away from the first corner frame support is welded to a reinforcing member extending in the circumferential direction of the tank.

19. A tank container according to claim 18, wherein an end of the U-bar facing the first corner frame support is supported by junction plates fitted between the U-bar legs and the tank shells.

20. A tank container according to claim 1, wherein each of four bottom corners of the tank containers are provided with corner frame supports and saddle structure means similar to said first corner frame support and said first saddle structure means.

* * * * *